US005799459A

United States Patent [19]

Covert

[11] Patent Number: 5,799,459

[45] Date of Patent: Sep. 1, 1998

[54] ROOFING SHINGLES AND SHINGLING METHOD

[76] Inventor: Roger C. Covert, 6042 Westknoll, Apt. 549, Grand Blanc, Mich. 48439

[21] Appl. No.: 813,383

[22] Filed: Mar. 6, 1997

Related U.S. Application Data

[60] Provisional application No. 60/013,089 Mar. 8, 1996.

[51] Int. Cl.[6] ..... E04D 1/12; B32B 7/10

[52] U.S. Cl. ..... 52/518; 52/420; 52/526; 156/71; 156/295

[58] Field of Search ..... 52/518, 420, 526, 52/543; 156/71, 295

[56] References Cited

U.S. PATENT DOCUMENTS

| | | | |
|---|---|---|---|
| 2,666,402 | 1/1954 | Clarvoe | 52/420 |
| 3,050,908 | 8/1962 | Schenk | 52/420 |
| 3,903,340 | 9/1975 | Shepherd | 52/420 X |
| 3,962,504 | 6/1976 | Sherwin | 52/420 X |
| 4,519,866 | 5/1985 | Stol | 156/295 |
| 4,529,466 | 7/1985 | Stol | 156/295 |
| 4,817,358 | 4/1989 | Lincoln et al. | 52/420 X |
| 4,856,251 | 8/1989 | Buck | 52/553 |
| 4,875,321 | 10/1989 | Rohner | 52/553 |
| 5,239,802 | 8/1993 | Robinson | 52/518 |
| 5,271,201 | 12/1993 | Noone et al. | 52/518 |
| 5,661,940 | 9/1997 | Wiens | 52/526 X |

FOREIGN PATENT DOCUMENTS

| | | |
|---|---|---|
| 963626 | 3/1975 | Canada . |
| 719013 | 2/1932 | France . |

*Primary Examiner*—Wynn Wood Coggins

[57] ABSTRACT

Shingles (10) have a plurality of apertures (30) in the upper portion (32) between the rain weeps (24 and 26) and the top edge (18). An adhesive container (12) is mounted in each of the apertures (30). The adhesive container (12) is struck by a hammer to increase the pressure of liquid adhesive in the container, rupture the container and force adhesive between the back surface (28) and a roof surface.

15 Claims, 2 Drawing Sheets

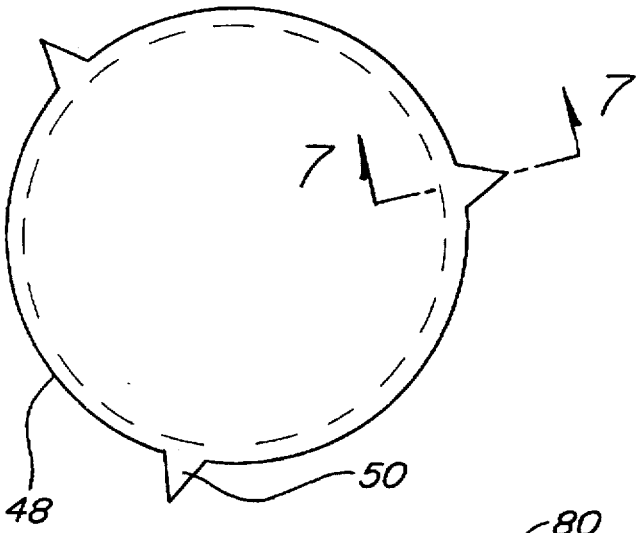
FIG - 4
FIG - 5
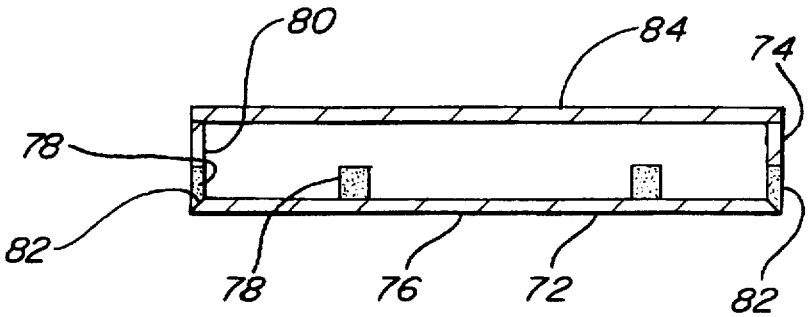
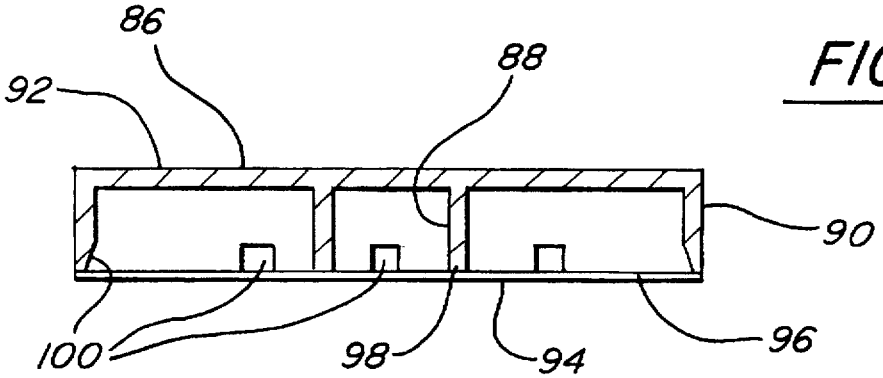
FIG - 6
FIG - 7
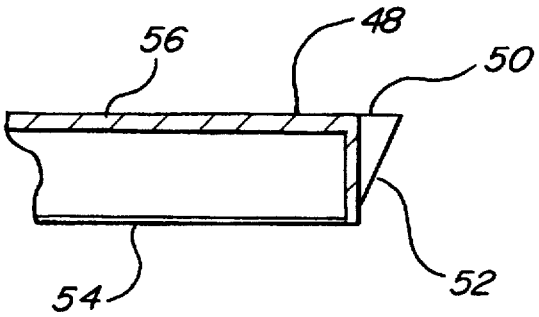

ROOFING SHINGLES AND SHINGLING METHOD

This application is based on PROVISIONAL APPLICATION No. 60/013.089 Filed Mar. 8, 1996.

BACKGROUND OF THE INVENTION

1. Field of the Invention

This invention relates to roofing shingles and a method of attaching shingles to a roof and more particularly to shingles secured to a roof by an adhesive.

2. Description of the Prior Art

Sloped roofs are generally covered with tile, slate, wood shingles, asphalt shingles or fiberglass shingles. Asphalt shingles and fiberglass shingles are commonly employed on residential buildings and some commercial buildings due to their relatively low cost and their resistance to fire. Asphalt and fiberglass shingles are however subject to damage by wind and have a limited life.

Asphalt and fiberglass shingles are generally single layers of material in sections that are about thirty-six inches wide and twelve inches long. They are applied to a sloping roof surface in horizontal rows with the end of one shingle abutted against the end of an adjacent shingle. An upper row of shingles has a lower five to seven inches on top of the shingles in the lower adjacent horizontal row of shingles. Five to seven inches on the upper portion of a row of shingles extend above the top edge of the lower adjacent horizontal row of shingles. Additional rows of shingles are added until the shingle reach the peak of the roof.

Strips or areas of adhesive are provided on the lower portion of the back surface of some asphalt and fiberglass shingles. This adhesive is softened by heat from the sun and adheres to the upper surface of the lower row of shingles. The purpose of the adhesive strips is to hold the lower portion of a shingle down to reduce wind damage and to keep water from being blown up under shingles. It takes at least a few hours for heat to activate the adhesive, and may take several months if the shingles are placed on the roof in the fall or early winter season. When the adhesive strips are activated by heat, they merely hold one shingle in contact with another shingle. They do not fasten a shingle directly to a roof.

Narrow slots or cut outs called rain weeps are usually formed in the lower portion of the shingle surface. The rain weeps are parallel to the left and right edges. There are however shingles without rain weeps.

Nails with large flat heads were used in the past to fasten shingles to a wood roof. These nails generally hold shingles securely if they have sufficient length and the wood that the nails penetrate is in sound condition. Many roofing contractors have stopped using nails because it takes too much time to fasten shingles down with them. To reduce time and thereby reduce installation costs, many roofing contractors employ powered staple guns to secure shingles to roofs. The staple guns are powered by electricity or by compressed air. Electricity is not available at some building sites. Where electricity is available, electric cables have to be moved across the roof. When air powered staplers are used, air lines must be moved across the roof. Both air lines and electric cables are big hazards on the sloped roof of a building. They can cause slips and falls that may result in a roofer falling off a roof. It also takes time to move electric cables and air hoses across the roof. Powered stapler machines require maintenance, reloading of staples and replacement after a period of use. The most serious problem with staples however is their frequent failure to hold shingles on a roof. The failure to hold shingles can result from the staples pulling from the wood support structure. The failure to hold shingles can also result from the staples cutting slots in the shingles and pulling through the shingles.

SUMMARY OF THE INVENTION

An object of the invention is to secure shingles to a roof with an adhesive.

Another object of the invention is to secure an adhesive container to a shingle.

A further object of the invention is to provide an adhesive container, attached to a shingle that can be ruptured to dispense adhesive by being struck with a hammer.

The shingles have apertures through their upper portion. The apertures are larger than the head of a hammer. An adhesive container is inserted in to each aperture. The container is about the same thickness as the shingle. The shingle is placed in a desired position on the roof of a building. The adhesive container is then struck with a hammer. The blow ruptures the container discharging adhesive from the container to the area between an under surface of the shingle and a stable surface of the roof. The container has weakened areas that insure the discharge of adhesive to the desired locations between the back surface of a shingle and a surface of the roof. The surface of the roof is usually a wood or wood product type material such as flake board, plywood or composite panel. The adhesive dispensed from the adhesive container is a fast setting liquid that secures shingles quickly so that adhered shingles can be walked upon and additional shingles can be placed on the roof.

The foregoing and other objects, features and advantages of the roofing shingles, and shingle applying and securing method will become apparent in view of the detailed description and the drawing described therein.

BRIEF DESCRIPTION OF THE DRAWINGS

FIG. 4 is an enlarged top plan view of one of the adhesive containers with another alternate container retainer system;

FIG. 5 is an enlarged sectional view of an adhesive container with a controlled adhesive dispensing system;

FIG. 6 is an enlarged sectional view of an adhesive container similar to FIG. 3 for a two component adhesive; and FIG. 7 is an enlarged sectional view taken along line 7—7 in FIG. 4.

DESCRIPTION OF THE PREFERRED EMBODIMENTS

Figure 1:
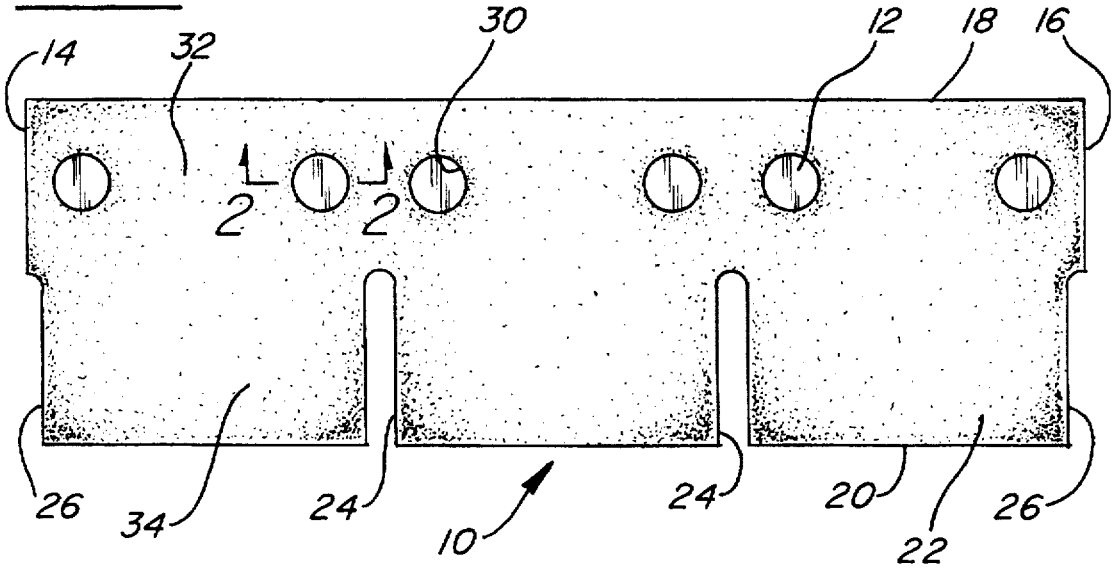
FIG. 1 is a top plan view of a shingle and adhesive containers of this invention.

The shingle 10 with adhesive containers 12 is shown in FIG. 1. The shingle 10 has left and right edges 14 and 16, an upper edge 18, and a lower edge 20. A top surface 22 of the shingle 10 is a flat surface that extends from edge 14 to edge 16 and from the top edge 18 to the bottom edge 20. Two full cut outs or rain weeps 24 and two half-cut outs or rain weeps 26 extend from the bottom edge 20 toward the top edge 18.

The rain weeps 24 and 26 provide guides for applying upper rows of shingles. The rain weeps 24 and 26 also divide the top surface 22 into an upper portion 32 between the rain weeps and the top edge 18 and a lower portion 34 between the bottom edge 20 and a portion of the rain weeps closest to the top edge. The shingle 10 also has a back surface 28. The back surface 28 is generally in a flat plane.

Sculptured shingles have been constructed in recent years by attaching additional layers of shingle material to the top surface 22 and/or the back surface 28 of the shingle 10 described above. With sculptured shingles, the rain weeps 24 and 26 may be eliminated. Sculptured shingles as well as the single ply shingles can be secured to a roof by adhesive from adhesive containers 12.

Heat activated adhesive strips (not shown) are frequently applied to the top surface 22 and back surfaces 28 of shingles 10. These strips are placed in various locations and patterns. Their primary function is to bond an upper shingle 10 to a lower shingle to prevent the wind from lifting shingle bottom edges 20 and to prevent wind from blowing water under shingles. These adhesive strips have not been used to attach shingles directly to the surface of a roof which is normally wood but could also be made from other materials.

Apertures 30 are formed in the upper portion 32 of the shingle 10. As shown in FIG. 1 there are six apertures 30 between the lower portion 34 with the rain weeps 24 and 26 and the top edge 18. The number of apertures 30 can be varied as required. The location of the apertures 30 can also be changed as required. The rain weeps 24 and 26 of one row of shingles 10 are generally half way between the rain weeps of adjacent rows of shingles. If this pattern is used, the apertures 30 cannot be laterally positioned mid way between the rain weeps 24 and 26. The apertures 30 are also positioned in the upper portion 32 spaced from the top edge 18.

An adhesive container 12 is positioned in each aperture 30. A variety of materials and fabrication procedures can be used to form the adhesive containers 12. A variety of retainer systems, for retaining an adhesive container 12 in an aperture 30, can also be employed. The adhesive container 12 should not be significantly thicker than the shingle 10. If the adhesive container's 12 are much thicker than the shingle 10, they will interfere with shingle stacking and packaging.

The adhesive container's 12 must have a diameter that is larger than the head of a hammer. If the diameter of the adhesive container 12 is only slightly larger than the striking end of a hammer, it will be difficult to strike the container with a hammer, rupture the container and dispense the adhesive.

The adhesive container 12 could be made from a plastic material that is formed into a cup shaped container with heat and vacuum. A membrane cover is heat sealed to the cups after the cup portion is filled with an adhesive or an adhesive component.

Figure 2:
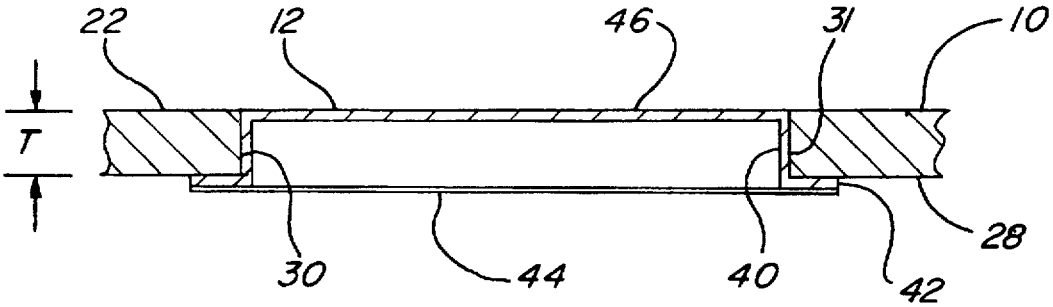
FIG. 2 is an enlarged sectional view of a shingle taken along line 2—2 in FIG. 1.

The adhesive container 12 shown in FIGS. 1 and 2 includes a hat shaped body 40 with a radially extending flange 42. The flange 42 is relatively thin so that the total thickness of the container 12 is only slightly more than the thickness T of the shingle 10 as shown in FIG. 2. The flange 42 keeps the container 12 from being knocked from the aperture 30 in one direction. The shingles 10 are stored and moved with the flanges 42 between two shingles until they are ready to be attached to the roof of a building. Friction between the aperture 30 and the sides 31 of the hat shaped body 40 retain the hat shaped body in the aperture 30 while the shingles are positioned on the surface of a roof. Adhesive is retained in the container 12 by a thin film 44 that is heat sealed to the flange 42. When the top wall 46 of the hat shaped body 40 is struck by a hammer, the thin film 44 ruptures where it joins the flange 42 and the flange directs adhesive radially outward parallel to the back surface 28 of the shingle 10 and between the shingle and the roof deck. The flange 42 also insures that adhesive does not move upwardly between the wall surface of the aperture 30 and the body 40 of the container body 12.

An alternate adhesive container 48 is shown in FIG. 4. The container 48 is a cylinder with three radially extending ribs 50 spaced one hundred and twenty degrees apart. The radial ribs 50 cut into the sides of an aperture 30 when the container 48 is pressed into the aperture. Friction between the shingle 10 and the radial ribs 50 hold the container 48 in the aperture 30. The ribs 50 have a tapered outer edge 52 as shown in FIG. 7. The tapered outer edge 52 makes it easier to insert the container 48 in the aperture 30. The container 48 is closed by a membrane 54 that is preferably heat sealed after adhesive is placed in the container. The membrane 54 ruptures to dispense adhesive when the container 48 is struck on its upper surface 56 by a hammer.

Figure 3:
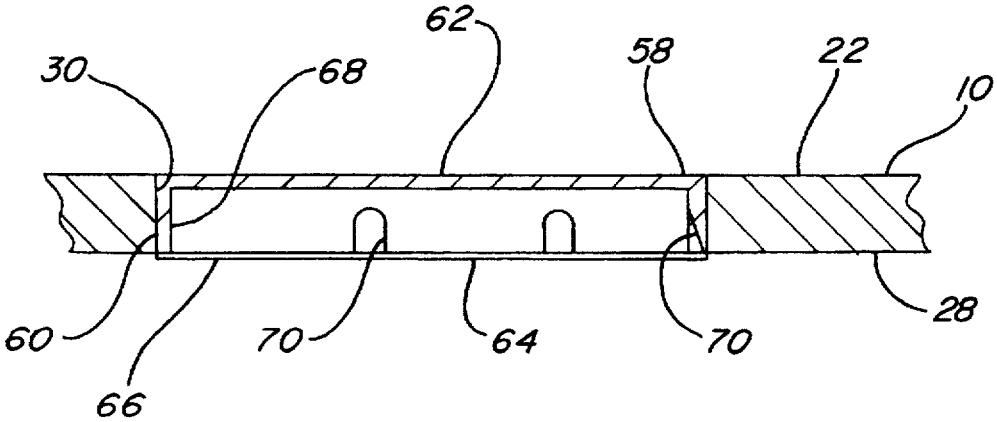
FIG. 3 is a sectional view similar to FIG. 2 with portions of the shingle broken away and showing an alternate adhesive container retainer system.

Another cylindrical container 58 is shown in FIG. 3. The cylindrical container 58 has smooth outer cylindrical surface 60, an integral top wall 62 and a membrane cover 64. The container 58 is held in the aperture 30 by friction or by an adhesive. The membrane cover 64 is sealed to the open edge 66 of the cylindrical wall 68 after adhesive is placed in the body of the container 58 by heat or an adhesive. The cylindrical wall has a series of wedge shaped recesses 70 adjacent to the open edge 66. The recesses 70 decrease the area of the open edge 66 to create a weak seal between the membrane cover 64 and the edge 66. When the top wall 62 is struck by a hammer, the increased pressure on the adhesive that fills the container 58 ruptures the seal between the cover 64 and the open edge at the recesses 70. By choosing the location of the recesses 70, the locations where adhesive is discharged can be controlled.

The adhesive container 72 shown in FIG. 5 is similar to the container 58 described above. The container 72 has a cylindrical body 74 with a flat integral bottom wall 76. A series of recesses 78 are provided where the bottom wall meets the side walls 80 of the body 74. The recesses 78 do not pass completely through the body 74. A thin membrane 82 closes each recess 78. A tough membrane cover 84 covers the top of the cylindrical body 74 and is bonded in place. When the membrane cove 84 is struck by a hammer, the thin membranes 82 that close the recesses 78 rupture to dispense adhesive. The membrane cover 84 does not rupture.

High strength adhesives are available today that have two separate parts. The first part is the adhesive. A smaller second part activates the adhesive and causes it to set when the two parts are mixed together. An adhesive container 86 for a two part adhesive is shown in FIG. 86. The container 86 has a smaller container 88 inside the outer cylindrical container 90. The smaller container 88 and the outer cylindrical container 90 are integral with a flat top wall 92. A cover 94 is bonded to the open edge 96 of the container 90 and to the open edge 98 of the container 88 to separate the first and second parts of the adhesive. Wedge shaped recesses 100 are provided in the container walls 88 and 90. The wedge shaped recesses 100 create weak points that rupture when the top walls 92 is struck by a hammer or other blunt tool. The two parts are mixed together and dispensed as explained above.

Several embodiments of the present invention have been described above. Changes and modifications may be made in the illustrated embodiments without departing from the spirit of the invention.

I claim:

1. A roofing shingle comprising a generally flat sheet having a left edge, a right edge, an upper edge, a lower edge, a top surface, a back surface, a lower portion extending from the left edge to the right edge and from the lower edge toward the upper edge, an upper portion extending from the left edge to the right edge and from the upper edge to the lower portion about mid way between the upper edge and the lower edge, and a plurality of apertures passing through the upper portion from the top surface to the back surface; and an adhesive container containing a liquid adhesive mounted in each of said plurality of apertures and having a container portion that will rupture upon the pressure of liquid in the adhesive container reaching a predetermined pressure.

2. A roofing shingle as set forth in claim 1 wherein the adhesive container has a flange that extends radially outward to form a hat shaped body.

3. A roofing shingle as set forth in claim 2 wherein each of the plurality of the adhesive containers has a membrane cover that adheres to the flange.

4. A roofing shingle as set forth in claim 1 wherein each of the adhesive containers has a plurality of radially extending ribs that are imbedded in the flat sheet to secure the adhesive contained in one of the plurality of apertures.

5. A roofing shingle as set forth in claim 1 wherein each of the adhesive containers has a body with an open edge, a plurality of recesses in the body that meet the open edge and a cover adhered to the open edge and forming a weak seal where each of the plurality of recesses is formed in the body.

6. A roofing shingle as set forth in claim 1 wherein each of the adhesive containers has a body with an open edge, a plurality of recesses in the body that are spaced from the open edge and closed by a thin membrane, and a cover adhered to the open edge and forming a seal that holds more fluid pressure than the thin membrane closing each of the plurality of recesses.

7. A roofing shingle as set forth in claim 1 wherein each of the adhesive containers has a thickness that is substantially equal to the distance between the top surface and the back surface.

8. A roofing shingle as set forth in claim 7 wherein each adhesive container has a surface in a plane parallel to the top surface of the generally flat sheet that is at least as large as the striking surface of a carpenter's hammer.

9. A roofing shingle a set forth in claim 7 wherein each of the plurality of apertures has a minimum width in a plane parallel to the top surface of 1.25 inches.

10. A roofing shingle as set forth in claim 1 wherein each of the adhesive containers includes a primary adhesive component compartment and a secondary adhesive component compartment both of which are rupturable.

11. A roofing shingle as set forth in claim 10 wherein the secondary adhesive component compartment is within the primary adhesive component compartment.

12. A method of attaching a shingle to a roof surface, wherein the shingle includes a generally flat sheet having a left edge, a right edge, an upper edge, a lower, a top surface, a back surface and a plurality of apertures through the generally flat sheet comprising:

a. mounting an adhesive container containing a liquid adhesive in each of the apertures;

b. placing the shingle on the roof surface with at least one of the adhesive containers in contact with the roof surface; and c. striking the at least one of the adhesive containers with a blunt object to compress the adhesive container between the blunt object and the roof surface, rupture the at least one of the adhesive containers, and force the liquid adhesive into contact with the shingle back surface and the roof surface.

13. A method of attaching a shingle to a roof surface as set forth in claim 12 wherein the blunt object which strikes the at least one of the adhesive containers is a hammer.

14. A method of attaching a shingle to a roof surface wherein the shingle includes a generally flat sheet having a left edge, a right edge, an upper edge, a lower edge, a top surface, a back surface, a plurality of apertures through the generally flat sheet and an adhesive container containing a liquid adhesive mounted in each of the apertures comprising:

a. placing the shingle on the roof surface; and b. compressing each of the adhesive containers between the roof surface and a tool to rupture each of the adhesive containers and force the liquid adhesive from each of the adhesive containers and into contact with the shingle back surface and the roof surface.

15. A method of attaching a shingle to a roof surface as set forth in claim 14 wherein the tool is a hammer.

* * * * *